United States Patent [19]

Roca-Nierga et al.

[11] Patent Number: 4,502,445

[45] Date of Patent: Mar. 5, 1985

[54] DELIVERY REGULATOR FOR A FUEL INJECTION PUMP

[75] Inventors: Manuel Roca-Nierga, Leghorn; Giuliano Lenzi, Arese, both of Italy

[73] Assignee: Spica, S.p.A., Leghorn, Italy

[21] Appl. No.: 483,195

[22] Filed: Apr. 8, 1983

[30] Foreign Application Priority Data

Apr. 19, 1982 [IT] Italy ..... 20805 A/82

[51] Int. Cl.[3] ..... F02M 59/20

[52] U.S. Cl. ..... 123/458; 123/459; 123/460; 123/502; 123/503

[58] Field of Search ..... 123/458, 459, 460, 502, 123/503, 500, 506

[56] References Cited

U.S. PATENT DOCUMENTS

| | | | |
|---|---|---|---|
| 3,699,939 | 10/1972 | Eckert et al. | 123/506 |
| 4,348,998 | 9/1982 | Stumpp | 123/459 |
| 4,395,987 | 8/1983 | Kobayashi et al. | 123/458 |
| 4,398,519 | 8/1983 | Tissot et al. | 123/459 |

FOREIGN PATENT DOCUMENTS

| | | | |
|---|---|---|---|
| 2061403 | 5/1981 | United Kingdom | 123/506 |
| 2079382 | 1/1982 | United Kingdom | 123/446 |
| 686637 | 9/1979 | U.S.S.R. | 123/449 |

*Primary Examiner*—Magdalen Y. C. Moy
*Attorney, Agent, or Firm*—Diller, Ramik & Wight

[57] ABSTRACT

The invention relates to an internal combustion engine injection pump provided with a regulator unit comprising a mobile valving element on which there act an actuator, elastic means, and the back-pressure of the fuel discharged by the pump on delivery interruption, in order to improve the response characteristics of the regulator unit.

15 Claims, 6 Drawing Figures

Fig.4
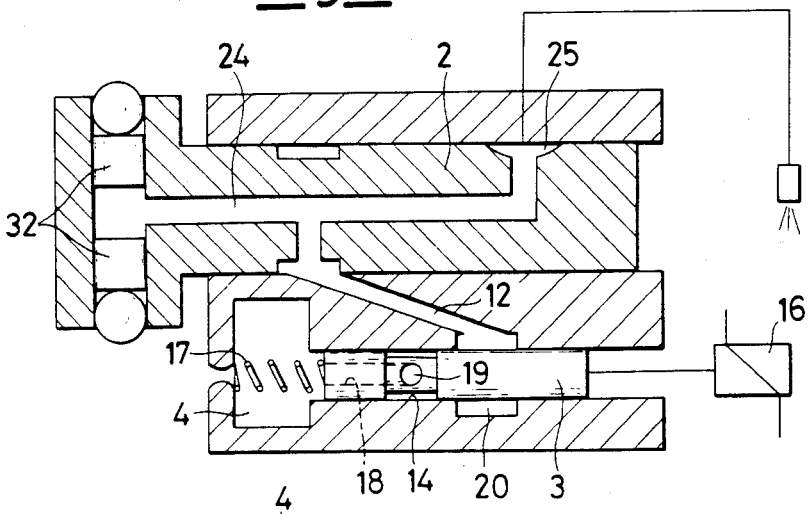
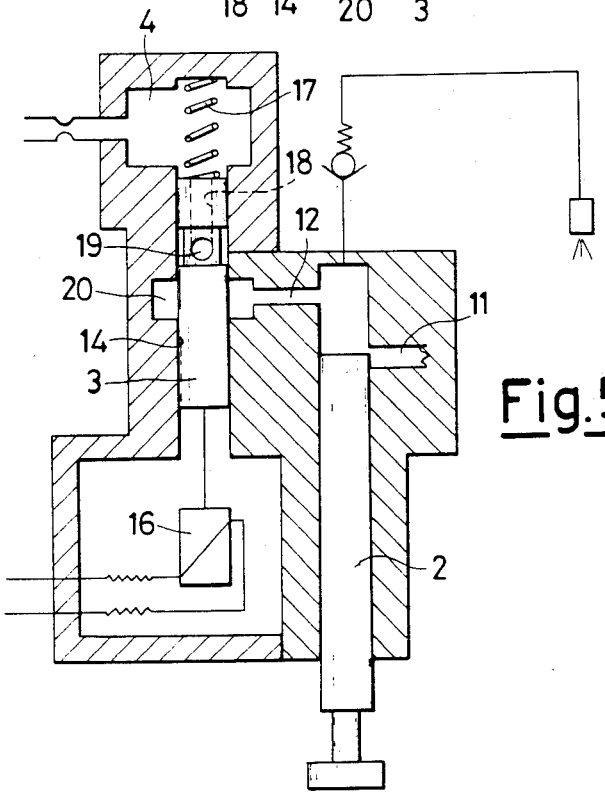
Fig.5

DELIVERY REGULATOR FOR A FUEL INJECTION PUMP

With fuel injection pumps there must be associated a control device which regulates the fuel delivery as a function of the position of a control member controlled by the operator, and of the braking load applied to the internal combustion engine.

This control device is commonly known as a speed governor, and is mostly constructed on mechanical or hydraulic principles. Certain drawbacks are however associated with these types of regulators. The main drawback is the timing delay due to the regulator frequency characteristics and the inertia of the injection pump control members. Moreover, complicated devices have to be added in order to perform other auxiliary functions (torque correction, maximum throughput limitation in accordance with the booster feed pressure, excess fuel on starting etc.).

To obviate these drawbacks, various types of electrically or electronically controlled regulators have appeared in recent years, and which by acting on suitable actuators enable the most complicated regulation programmes to be fulfilled.

In one of the known systems (Galan, U.S. Pat. No. 4,216,752), a rotating double valve distributor is used to discharge part of the delivery stroke effected by the pumping unit. This system is however costly and bulky due to the presence of two large electromagnets necessary to overcome the opposing force of an elastic return bar.

Another known system (Mannhardt, U.S. Pat. No. 4,136,655) utilises the movement of an electrically controlled spool in order to deliver the fuel, but this does not represent true electronic regulation because the electrical signal does not undergo modulation, and the throughput is controlled by manual or automatic rotation of the spool. This system requires the presence of further valve means for preventing fuel delivery as the spool returns to its initial position.

A further known system (Bosch, GB No. 2,034,400A) electrically determines the positioning of the throughput control member as normally done by current mechanical regulators, and has the same level of overall size and cost as these.

Other systems (Lucas, GB No. 2,037,884A) directly control the opening timing of the injection valve by acting on the valve needle. These systems are however directly subjected to the high pressure necessary for injection, and must oppose its thrust. This requires large forces and consequent considerable size of the actuator solenoid.

Finally, another system (Lucas Bryce) utilises the principle of a needle seal in order to discharge part of the working stroke of the pumping unit. However, this system is also subjected to high pressure, and must therefore comprise solenoids capable of considerable force. It must also be considered that this considerable force can quickly cause the loss of the perfect seal at the seat of the control needle. Finally, it should be noted that to ensure rapid delivery interruption in order to prevent injection dribbling or injector dripping, some of the aforesaid systems utilise the thrust obtained by robust elastic means, which must afterwards overcome the considerable load in returning to their initial position. This produces a further need for bulky high-energy control electromagnets.

In order to obviate the influence of high pressure on the operating parameters of the electronic regulator device and of the relative loads, certain systems (FR No. 2,095,695, FR No. 2,188,065, and GB No. 2,076,561) appeared during the 1970's which used a cylindrical distributor provided with a high pressure balancing duct and connected to an electromagnet in order to selectively discharge the pump pressure chamber, thus determining the quantity of fuel delivered.

Said systems attain the required object, but have the drawback of requiring robust elastic return means and thus powerful electromagnetic control devices in order to ensure rapid delivery interruption. The direct use of the electromagnet to open the discharge port and determine the cessation of injection, as provided by some systems, does not solve the problem because it requires the same thrust level in order to rapidly overcome the inertia resistance of the distributor. The object of the present invention is therefore to simply and conveniently solve the problem of effective and versatile electronic regulation of a fuel injection pump, using a system for rapidly interrupting injection which during its return to its initial position does not determine any thrust opposing the action of the actuator solenoid.

To this end, the device uses a cylindrical shuttle mobile along its longitudinal axis and provided with ducts for balancing the high pressure in order to modify its thrust, the shuttle being disposed branching from the pressure chamber of a fuel injection pump, whether this be of single cylinder, in-line or distributor type, said shuttle being provided with electrical or mechanical control means which, in cooperation with elastic return means, move the transfer ports provided in the shuttle into a position corresponding with the connection duct to the injection pump, in order to put the pressure chamber of said pump into irregular communication with the low pressure chamber containing the pumping unit operating mechanisms.

During the period in which the high and low pressure chambers are connected together, the pumped fuel is subjected to discharge during the rising stage of the pump piston, in order to control the injected fuel quantity, whereas during the piston falling stage, the fuel is fed to the pumping unit in order to improve its filling.

In the basic version, delivery commencement remains constant and is determined by the pump pistion during its rising stroke covering one or more feed ducts present in the cylinder, whereas delivery termination is variable and is determined by the valve action of the shuttle which, by controlled movement from a first position to a second position, selectively connects the pump to discharge for the entire remaining rising period.

As already stated, rapid and precise delivery interruption is necessary on termination of delivery in order to prevent injection dribbling or injector dripping, and therefore the invention is characterised by the presence of a back-pressure chamber fitted with a discharge jet and able to accelerate the movement of the shuttle valve during its opening of the port which connects to the pressure chamber of the fuel injection pump.

The structural and operational characteristics of the invention and its advantages over the known art will be more apparent from an examination of the description given hereinafter by way of example, with reference to the accompanying diagrammatic drawings in which:

FIG. 4 is a section showing a different distributor-type pump with the regulator device of the present invention fitted;

FIG. 5 shows the same device applied to the pumping element of a single-cylinder or in-line injection pump;

Figure 1:
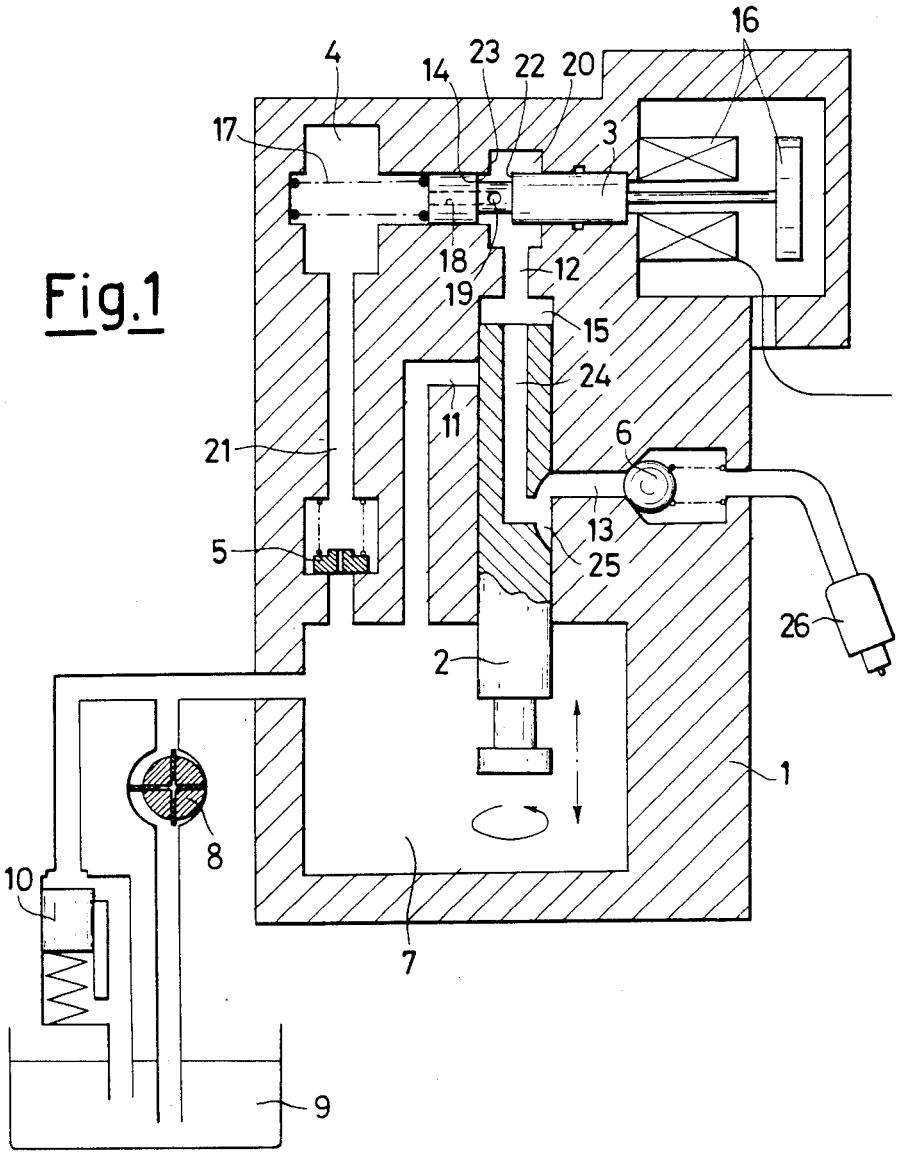
FIG. 1 is a section showing an injection pump of the distributor type constructed in accordance with the principles of the invention.

With reference to FIG. 1, the injection pump casing 1, shown in diagrammatic elementary form, contains a hydraulic head composed of a pumping element 2, a mobile regulator element or plunger 3, a back-pressure chamber 4, an orifice valve or orifice-disc valve 5 and a number of delivery valves 6 equal to the number of engine cylinders to be fed.

The lower chamber 7 of the injection pump 1 is fed with fuel by a pump 8 connected to the tank 9 and provided with an overpressure valve 10. By known mechanisms, not shown, the pumping element or piston 2 is driven with reciprocating and rotary motion to determine the fuel intake, pumping and distribution action in phase with the uncovering or covering of the feed and discharge ducts 11 and 12 and of the delivery ducts 13. The regulator element 3, formed as a plunger tightly slidable in a cylindrical housing 14 connected by the duct 12 to the injection pump pressure chamber 15, moves longitudinally under the control of the energisation of the thrust solenoid 16 and the return spring 17, in order to effect a valve action between said pressure chamber 15 and the chamber 4 disposed downstream of the regulator element 3. For this purpose, the plunger 3 is provided in that surface facing the chamber 4, with an axial bore 18 which by way of a transverse bore 19 opens in a position corresponding with a sunken collar formed on said plunger 3. In order to prevent the thrust which originates from the high pressure existing in the pressure chamber 15 during the delivery stage from preventing the movement of the regulator plunger 3, the connection duct 12 opens at the regulator end in the hydraulic thrust balancing chamber 20.

Figure 2:
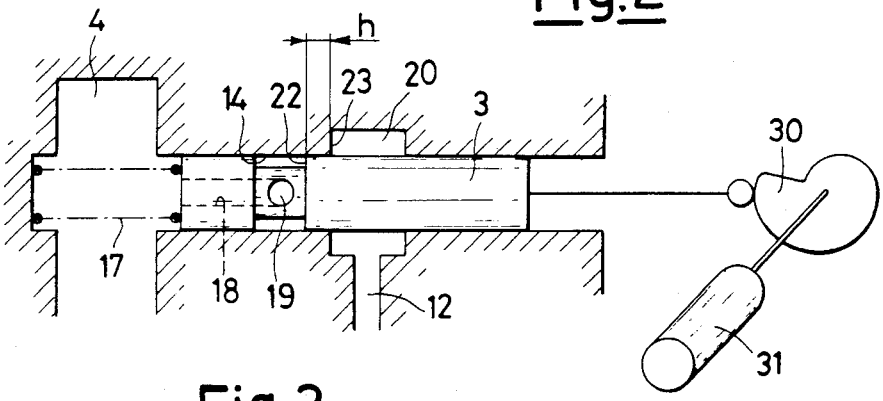
FIG. 2 shows a modification of the regulator device controlled by a circular cam.

The back-pressure chamber 4 is connected by the duct 21 and the orifice-disc valve 5 to the lower chamber 7 of the injection pump 1, into which the fuel fed by the pump 8 flows at low pressure. In order to illustrate the operation of the entire apparatus, it is advantageous to commence with the situation existing when the piston 2 is at its bottom dead centre. Under these conditions, the solenoid 16 is energised, and the regulator plunger 3 is displaced into its end position towards the back-pressure chamber 4. The connection between said chamber 4 and the pressure chamber 15 is therefore interrupted because the edge 22 of the plunger 3 has passed, in terms of its axial position, beyond the cooperating edge 23 of the balancing chamber 20, thus determining a sealing band of width h (see FIG. 2) between the plunger 3 and its cylindrical housing 14.

In this situation, the fuel pumping stage commences when during the next rising stroke of the piston 2 the upper edge of said piston 2 completely covers the terminal section of the connection bore 11 to the low pressure chamber 7. The liquid compressed in the chamber 15 is then directed by the axial bore 24 and the distribution cavity 25 of the piston 2, towards one of the delivery ducts 13 and thus towards one of the injectors 26.

The delivery stage terminates when, on de-energising the solenoid 16, the thrust spring 17 causes the regulator plunger 3 to move through a stroke equal to the width h of the annular sealing band. This is because from this position onwards there becomes created between the edge 23 of the balancing chamber 20 and the edge 22 of the plunger 3 an annular discharge section, the size of which increases as the regulator plunger 3 moves towards its rest position most distant from the chamber 4.

Varying the instant of de-energisation of the solenoid 16 relative to the stroke of the piston 2 thus determines a corresponding variation in the quantity of fuel injected for each rising stroke of the piston 2. Electronic signal modulation can therefore enable the throughput programme most suitable for the requirements of the user to be chosen. This programme can comprise certain particular functions which are required at the present time in regulators (torque correction, supplementary feed for starting, etc.), and is perfectly suitable for accepting other information arriving from the various sensors, such as engine temperature, barometric pressure, booster feed pressure, etc. In order to accelerate the axial movement of the plunger 3 after the aforesaid discharge port has begun to be uncovered, and thus determine a rapid increase in the discharge cross-section and a consequent precise interruption of the fuel injection stage, the chamber 4 is provided downstream of the regulator plunger, and is connected to the low pressure chamber 7 by way of the orifice of the orifice valve 5. The volume of the chamber 4 is such that when the discharge port becomes uncovered, there is a rapid decompression of the zone subjected to high pressure, however the orifice contained in the valve 5 prevents the pressure in the chamber 4 falling rapidly to the low value existing in the chamber 7. The intermediate pressure which thus arises in the chamber 4 then presses against the front surface of the regulator plunger 3, and by supplementing the thrust of the spring 17 determines a more rapid movement of said plunger 3, with a consequently more rapid increase in the high pressure discharge cross-section. During the first part of the falling stroke of the piston 2, the regulator plunger 3 remains in its rest position most distant from the back-pressure chamber 4, thus leaving the connection between the chamber 15 of the pumping element 2 and said chamber 4 open. The fuel contained in the injection pump chamber 7 can thus open (raise) the valve 5, overcoming the resistance of the weak return spring (unnumbered), to fill the pumping element 2 by way of the duct 21, the chamber 4, the bore 18 of the plunger 3, the balancing chamber 20, and the duct 12. If the available time is short, the filling operation can be facilitated by providing in the top of the piston 2 suitable longitudinal cavities for connecting the chamber 15 to the feed duct 11. Because of the piston rotation movement, these cavities become offset during the pumping element rising stroke, so that they are not connected to the duct 11.

During the lower part of the pumping element intake stroke, the solenoid is again energised, and the regulator plunger overcomes the resistance of the thrust spring 17 to move firstly into a position closing the connection between the duct 12 and the back-pressure chamber 4, and finally into its end-of-stroke position close to said chamber 4, in order to restore the annular sealing band of width h between said plunger and the cylindrical bore 14.

Because, as stated, the pumping piston 2 is in its intake stage, the plunger 3 during its return to its initial position close to the chamber 4 encounters only the opposition of the spring 17. The necessary force and thus the size of the solenoid valve 16 are consequently small.

In this manner, in accordance with the object of the invention, a system is provided for accelerating the opening of the discharge duct on termination of delivery without affecting the force required to restore the initial position of the mobile member. During the final part of the intake stroke of the piston 2, the connection between the chamber 15 and the auxiliary chamber 4 is interrupted, as already noted. The pumping element 2 can however complete the filling action through the duct 11.

In this embodiment shown in FIG. 1, the regulator plunger 3 is driven by a solenoid electromagnet 16. This actuator can be replaced by equivalent mechanical means. Thus, a circular cam 30 (FIG. 2) or a frontal cam could be used connected for example to a motor 31 of the servo-controlled or stepping type. The cam 30 would then move the distributor in the sense of closing the connection bore to the pumping element chamber 15, whereas the spring 17, aided by the discharge back-pressure, would effect its rapid opening.

A further modification of the regulator device comprises controlling the throughput by controlling the commencement of delivery, instead of the termination of delivery as described heretofore. This would thus be an injection system of variable delivery commencement and constant termination.

Figure 3:
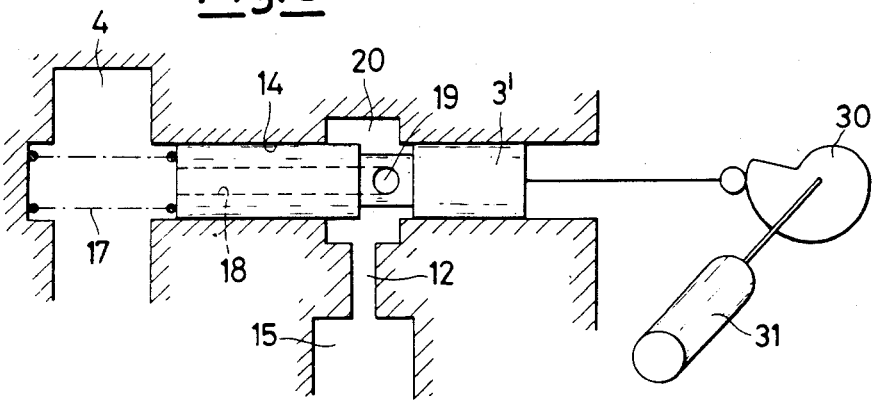
FIG. 3 shows a modification of the device of FIG. 2 with delivery commencement regulation.

One embodiment is shown in FIG. 3. The regulator plunger 3' keeps the connection between the pressure chamber 15 and the decompression chamber 4 open for the entire pumping element intake period and for part of its rising stroke. The delivery is thus fed to discharge until the moment in which the cam 30 enables the plunger 3', operated by the return spring 17, to close the connection with the pumping element pressure chamber 15, thus enabling the injection stage to commence. The constant delivery termination is determined by the uncovering of a discharge duct by the pumping piston or by the attainment of the piston top dead centre.

The use of an electronically controlled actuator system also enables fuel feed to be selectively excluded from one or more engine cylinders in order to obtain modular engine operation. In such a case, it is necessary only to nullify the electromechanical actuator energisation pulse corresponding to the determined cylinder so that all the fuel pumped during the piston rising stroke is discharged through the regulator valve 3, which is kept constantly open by the spring 17. It is apparent that throughput regulator devices according to the invention are applicable to any type of injection pump without leaving the scope of the invention. By way of example, FIG. 4 shows the regulator device connected to the pressure chamber of a known distributor-type pump comprising opposing plungers 32, and FIG. 5 shows the same device applied to the element of an in-line injection pump. In these Figures, parts equivalent to those illustrated in the preceding Figures are given the same reference numerals.

The plunger of the regulator element can assume different forms from those shown in the preceding Figures, but being substantially equivalent functionally, in particular with respect to the hydraulic thrusts which are required to act on it for correct operation.

Figure 6:
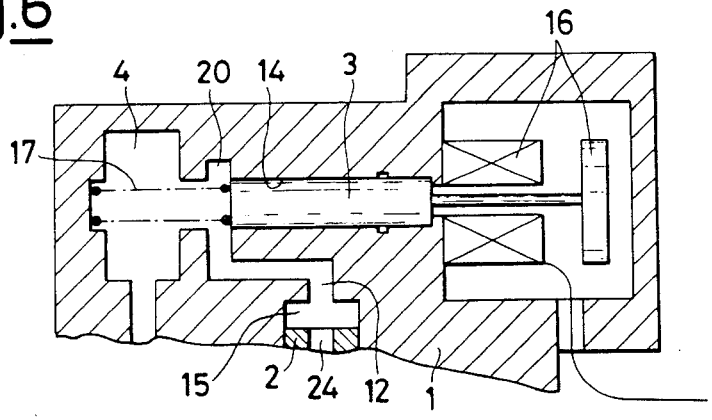
FIG. 6 is a partial view of a modification of the device of FIG. 1.

As shown in FIG. 6, the plunger edge can be constituted by the edge of the face of the piston 3, which cooperates with an edge of the chamber in which it moves.

We claim:

1. A fuel injection pump comprising at least one pumping unit which feeds fuel to at least one injector associated with an internal combustion engine cylinder, a regulator unit for regulating the pumping unit displacement, characterized in that said regulator unit comprises a duct which connects a pump feed pipe to a pressure chamber of said pumping unit successively by way of a non-return valve in parallel with a passage of predetermined size and by way of valve means of which a valving element is moved into the closed state by an actuator against the action of elastic means, one face of said valving element being subjected to the pressure of the liquid existing in a duct portion between said valve means and said passage of predetermined size, said pressure acting on the valving element in the sense of moving it concurrently with the elastic means, and that portion of said duct between the non-return valve and the valve means has a volume many times greater than the pumping unit displacement.

2. An injection pump as claimed in claim 1, characterised in that said duct widens into an intermediate back-pressure chamber in a position corresponding to said valve means.

3. An injection pump as claimed in claim 1, characterised in that said valving element is in the form of a plunger.

4. An injection pump as claimed in claim 2, characterised in that said valve means is represented by a cylindrical plunger provided with an axial bore connected to said back-pressure chamber and opening into a sunken collar disposed in the central region of said cylindrical plunger, said cylindrical plunger being tightly slidable in a corresponding cylindrical housing and driven with reciprocating motion in order, when in its position closest to said intermediate back-pressure chamber, to interrupt the connection between said pumping unit pressure chamber and said back-pressure chamber.

5. A fuel injection pump comprising at least one pumping unit including at least one pumping element mounted for reciprocal movement relative to a pressure chamber, first duct means for delivering fuel into said pressure chamber, second duct means for delivering pressurized fuel from said pressure chamber to a delivery duct, third duct means for delivering fuel to said pressure chamber in parallel relationship to said first duct means, said third duct means including a restricted orifice and a movable valve disposed in serial relationship, said third duct means being defined in part by passage means in said movable valve for selectively maintaining fluid communication between said pressure chamber and a portion of said third duct means between said restricted orifice and said movable valve, actuator means for moving said movable valve means to a position closing off fluid communication through said passage means, means for biasing said movable valve in a direction opposite to the closing movement of said movable valve by said actuator means, and the force of fluid acting against said movable valve when the latter opens fluid communication through said passage means being in a direction additive to the force of said biasing means.

6. A fuel injection pump comprising at least one pumping unit including a fuel feed chamber, a pressure chamber and a pumping piston reciprocable in said pressure chamber, first duct means between said fuel feed chamber and said pressure chamber for delivering fuel into said pressure chamber, second duct means between said pressure chamber and at least one delivery duct for delivering pressurized fuel into said at least one delivery duct, third duct means between said fuel feed chamber and said pressure chamber in substantially parallel relationship to said first duct means, said third duct means comprising a restricted orifice and a movable valve means arranged in serial relationship and spaced for each oher by a portion of said third duct means, actuator means for moving said movable valve means between a position shutting off fluid communication between said pressure chamber and said portion of said third duct means and a position providing said fluid communication, and means for biasing said movable valve means in a direction opposite to the movement caused by said actuator means, whereby said restricted orifice causes pressure fluid in said portion of said third duct means between said restricted orifice and said movable valve means to act against said movable valve means in a drection additive to the force of said biasing means when said movable valve means provide said fluid communication between said pressure chamber and said portion of said third duct means.

7. A fuel injection pump as claimed in claim 6, wherein said portion of said third duct means has a volume many times greater than the delivery volume of said pumping pumping piston.

8. A fuel injection pump as claimed in claim 6, wherein said portion of said third duct means widens into an intermediate back-pressure chamber close to said movable valve means.

9. A fuel injection pump as claimed in claim 6, wherein said portion of said third duct means widens into an intermediate back-pressure chamber close to said movable valve means, and wherein said movable valve means comprise a substantially cylindrical plunger having an axial bore communicating with said back-pressure chamber and opening into a sunken collar of said plunger located at a position between opposite ends of said plunger, said plunger being tightly reciprocable in a corresponding substantially cylindrical housing between a position close to said intermediate back-pressure chamber in which fluid communication from said pressure chamber to said back-pressure chamber through said axial bore is shut off and a position farther away from said back-pressure chamber in which fluid communication between said pressure chamber and said back-pressure chamber through said axial bore is provided.

10. A fuel injection pump as claimed in claim 9, wherein said substantially cylindrical housing defines an enlarged annular chamber in a position substantially corresponding to the position assumed by said sunken collar when said plunger is in said position farther away from said back-pressure chamber, said enlarged annular chamber communicating with said pressure chamber and defining means for balancing lateral thrust on said cylindrical plunger by the pressure existing in said pressure chamber.

11. A fuel injection pump as claimed in claim 6, wherein said portion of said third duct widens into an intermediate back-pressure chamber close to said movable valve means, and wherein said biasing means are arranged in said intermediate back-pressure chamber.

12. A fuel injection pump as claimed in claim 6, wherein said actuator means is an electromagnet.

13. A fuel injection pump as claimed in claim 6, wherein said actuator means comprises a cam element rotatably driven by a step motor.

14. A fuel injection pump as claimed in claim 6, wherein said restricted orifice is a fixed orifice defined in said third duct means.

15. A fuel injection pump as claimed in claim 6, wherein said restricted orifice is an axial orifice defined in a check valve, said check valve being arranged in said third duct means such as to allow fluid communication in a direction between said feed chamber and said portion of said third duct means.

* * * * *